US011019433B2

(12) United States Patent
Pu et al.

(10) Patent No.: US 11,019,433 B2
(45) Date of Patent: May 25, 2021

(54) BEAM FORMER, BEAM FORMING METHOD AND HEARING AID SYSTEM

(71) Applicant: Starkey Laboratories, Inc., Eden Prairie, MN (US)

(72) Inventors: Wenqiang Pu, Guangdong (CN); Jinjun Xiao, Chanhassen, MN (US); Tao Zhang, Eden Prairie, MN (US); Zhiquan Luo, Maple Grove, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 16/605,518

(22) PCT Filed: Apr. 20, 2018

(86) PCT No.: PCT/CN2018/083930
§ 371 (c)(1),
(2) Date: Oct. 16, 2019

(87) PCT Pub. No.: WO2018/192571
PCT Pub. Date: Oct. 25, 2018

(65) Prior Publication Data

US 2020/0077205 A1 Mar. 5, 2020

(30) Foreign Application Priority Data

Apr. 20, 2017 (CN) ..... 201710259957.1

(51) Int. Cl.
*H04R 25/00* (2006.01)
*G10L 21/0216* (2013.01)

(52) U.S. Cl.
CPC ..... *H04R 25/407* (2013.01); *G10L 21/0216* (2013.01); *H04R 25/405* (2013.01); *G10L 2021/02166* (2013.01); *H04R 2225/43* (2013.01)

(58) Field of Classification Search
CPC ..... G10K 2200/00; G10K 2200/10; G10K 2210/3215; H04R 3/005; H04R 1/32; H04R 1/326; H04R 1/40; H04R 1/406; H04R 25/40; H04R 25/405; H04R 25/407; G10L 21/0216; G10L 2021/02166; G06F 17/11; G06F 30/20
See application file for complete search history.

(56) References Cited

U.S. PATENT DOCUMENTS 9,591,404 B1 * 3/2017 Chhetri ..... H04R 3/005

OTHER PUBLICATIONS

Allen et al., "Image method for efficiently simulating small-room acoustics", The Journal of the Acoustical Society of America, vol. 65, No. 4, 1979, pp. 943-950.

(Continued)

*Primary Examiner* — Walter F Briney, III
(74) *Attorney, Agent, or Firm* — Mueting Raasch Group

(57) ABSTRACT

Disclosed is a beam former, comprising: an apparatus for receiving a plurality of input signals; an apparatus for optimizing a mathematical model and solving an algorithm, which obtains a beam forming weight coefficient for carrying out linear combination on the plurality of input signals; and an apparatus for generating an output signal to the beam forming weight coefficient and the plurality of input signals.

14 Claims, 5 Drawing Sheets

(56) References Cited

OTHER PUBLICATIONS

Boyd et al., "Distributed optimization and statistical learning via the alternating direction method of multipliers", Foundations and Trends in Machine Learning, vol. 3, No. 1, 2011, pp. 1-125.
Doclo et al., "Acoustic beamforming for hearing aid applications" Handbook on Array Processing and Sensor networks, 2008, pp. 269-302.
Doclo et al., "Multichannel signal enhancement algorithms for assisted listening devices: Exploiting spatial diversity using multiple microphones", IEEE Signal Processing Magazine, vol. 32, No. 2, Mar. 2015, pp. 18-30.
Elko, "Microphone array systems for hands-free telecommunication", Speech Communication, vol. 20, No. 3-4, 1996, pp. 229-240.
Hadad et al., "The binaural LCMV beam-former and its performance analysis", IEEE/ACM Transactions on Audio, Speech, and Language Processing, vol. 24, No. 3, Mar. 2016, pp. 543-558.
Hadad et al., "Comparison of two bin-aural beamforming approaches for hearing aids", ICASSP, 2017, pp. 236-240.
Kates et al., "A comparison of hearing-aid array-processing techniques", The Journal of the Acoustical Society of America, vol. 99, No. 5, 1996, pp. 3138-3148.
Liao et al., "Incorporating spatial information in binaural beamforming for noise suppression in hearing aids", IEEE International Conference on Acoustics, Speech and Signal Processing (ICASSP), Apr. 2015, pp. 5733-5737.
Liao et al., "An effective low complexity binaural beamforming algorithm for hearing aids", IEEE Workshop on Applications of Signal Processing to Audio and Acoustics (WASPAA), Oct. 2015, pp. 1-5.
Mabande et al., "Design of robust superdirective beamformers as a convex optimization problem", 2009 IEEE International Conference on Acoustics, Speech and Signal Processing, Apr. 2009, pp. 77-80.
Spillet et al., "Robustness analysis of multichannel wiener filtering and generalized sidelobe cancellation for multimicrophone noise reduction in hearing aid applications", IEEE Transactions on Speech and Audio Processing, vol. 13, No. 4, Aug. 2005, pp. 487-503.

* cited by examiner

Algorithm: an ADMM augmented Lagrange method for solving Equation 5

Initialize $(w, \delta_\Theta, \delta_\Phi, \epsilon, \lambda_\Theta, \lambda_\Phi)$ Solve $\min_{w, \delta_\Theta, \delta_\Phi, \epsilon} w^H R_n w + \mu \max_k(\gamma_k \epsilon_k)$ $$\text{s.t.} \quad |\delta_\theta - 1|^2 \le c_\theta^2, \ \forall \theta \in \Theta,$$

$$\bar{h}_\theta^H w = \delta_\theta, \ \forall \theta \in \Theta,$$

$$|\delta_\phi|^2 \le \epsilon_k c_\phi^2, \ \forall \phi \in \Phi_k, \forall \ k,$$

$$\bar{h}_\phi^H w = \delta_\phi, \ \forall \phi \in \Phi_k, \forall \ k,$$

wherein $L_\rho(w, \delta_\Theta, \delta_\Phi, \epsilon, \lambda_\Theta, \lambda_\Phi) = w^H R_n w + \mu \max_k(\gamma_k \epsilon_k)$ $$+ \sum_{\theta \in \Theta} \mathrm{Re}\{\lambda_\theta^H(\bar{h}_\theta^H w - \delta_\theta)\} + \frac{\rho}{2}|\bar{h}_\theta^H w - \delta_\theta|^2$$

$$+ \sum_k \sum_{\phi \in \Phi_k} \mathrm{Re}\{\lambda_\phi^H(\bar{h}_\phi^H w - \delta_\phi)\} + \frac{\rho}{2}|\bar{h}_\phi^H w - \delta_\phi|^2.$$

Update a beam former $w^{r+1} = \arg\min_w L_\rho(w, \delta_\Theta^r, \delta_\Phi^r, \epsilon^r, \lambda_\Theta^r, \lambda_\Phi^r)$ update $\delta_\Theta^{r+1} = \arg \min_{\text{s.t.} \ |\delta_\theta - 1|^2 \le c_\theta^2} L_\rho(w^{r+1}, \delta_\Theta, \delta_\Phi^r, \epsilon^r, \lambda_\Theta^r, \lambda_\Phi^r)$ update $(\delta_\Phi^{r+1}, \epsilon^{r+1}) = \arg \min_{\text{s.t.} |\delta_\phi|^2 \le \epsilon_k c_\phi^2} L_\rho(w^{r+1}, \delta_\Theta^{r+1}, \delta_\Phi, \epsilon, \lambda_\Theta^r, \lambda_\Phi^r)$ update $\lambda_\Theta^{r+1} = \lambda_\Theta^r + \rho(\bar{H}_\Theta^H w - \delta_\Theta^{r+1})$ $\lambda_\Phi^{r+1} = \lambda_\Phi^r + \rho(\bar{H}_\Phi^H w - \delta_\Phi^{r+1})$

FIG. 2

BEAM FORMER, BEAM FORMING METHOD AND HEARING AID SYSTEM

TECHNICAL FIELD

The present application relates to a beam former, and specifically to a beam former used in a hearing aid and a beam forming method.

BACKGROUND

Hearing aids are used to transfer amplified sound to acoustic meatus of people with impaired hearing to help those people. Damages to cochlear outer hair cells of patients lead to the patients' loss of hearing frequency resolution. As this situation develops, the patients have difficulty in differentiating speech and ambient noise. Simple amplification cannot solve this problem. Therefore, it is necessary to help this type of patients understand speech in a noisy environment. A beam former is typically used in a hearing aid to distinguish speech from noise, thereby helping patients understand speech in a noisy environment.

According to the prior art, a linearly constrained minimum variance (LCMV) (E. Hadad, S. Doco and S. Gannot. "The binaural LCMV beam-former and its performance analysis," The IEEE/ACM Transactions on Audio. Speech, and Language Processing. Vol. 24, No. 3, pages 543-558, March 2016) beam former uses linear equality constraint to perform target protection and interference suppression. According to this method, an acoustic transfer function (ATF) corresponding to the target/interference is needed. In the case where there is an accurately estimated ATF, LCMV achieves excellent noise and interference reduction. In practices, such as hearing aid applications, the LCMV performance may significantly deteriorate due to errors in ATF estimate (E. Hadad, D. Marquardt, et. al. "Comparison of two binaural beamforming approaches for hearing aids," ICASSP, 2017).

Specifically, in order to process errors in the angle of arrival (DoA) (which may be caused by, for example, a hearing aid wearer moving his/her head) of a target, a robust beam former is developed recently (W. C. Liao, M. Hong, I. Merks, T. Zhang and Z. Q. Luo, "Incorporating spatial information in binaural beamforming for noise suppression in hearing aids," in the 2015 IEEE International Conference on Acoustics, Speech and Signal Processing (ICASSP), April 2015, pages 5733-5737, and W. C. Liao, Z. Q. Luo, 1. Merks and T. Zhang, "An effective low complexity binaural beamforming algorithm for hearing aids," IEEE Workshop on Applications of Signal Processing to Audio and Acoustics (WASPAA), October 201, pages 1-5), which relaxes the equality constraint in LCMV to an inequality constraint and introduces the so-called inequality constrained minimum variance (ICMV) beam former. The ICMV beam former can apply an additional constraint to an adjacent angle to achieve robustness for the DoA error or the ATF estimation error.

In LCMV and ICMV, the number of interferences that can be processed by the beam formers is limited by a degree of freedom (DoF) provided by a microphone array. The above-described limitation leads to restricted applications of the two types of beam formers in some environments where multiple people are speaking. In addition, DoF further limits the number of inequality constrains that can be applied in ICMV. As a result, the ICMV equation with robustness is unsolvable in some cases.

Therefore, to overcome the above defects, the inventors of the present application used the Convex Optimization Technique (S. Boyd and L. Vandenberghe, Convex Optimization, Cambridge, UK: Cambridge University Press, 2004) to review the problems with beam former design. The inventors focused on designing a beam former capable of processing multiple interferences under limited DoF conditions. By introducing a mechanism of inequality constrains to limit a boundary by a penalizing variable in a cost function, the number of inequality constrains can be increased without leading to the problem that it becomes unsolvable, so that the beam former can process all interferences in an environment without being limited by the array DoF. Hence, the beam former according to the concept of the present invention is named penalized-ICMV beam former or P-ICMV beam former in short. For the proposed equation, an iterative algorithm with low complexity based on an alternating direction method of multipliers (ADMM) was derived. This iterative algorithm provides an implementation manner of a simple beam former that can be potentially implemented in hearing aids.

SUMMARY

According to one embodiment of the present invention, the present application discloses a beam former, comprising: an apparatus for receiving a plurality of input signals, an apparatus for optimizing a mathematical model and solving an algorithm, which obtains a beam forming weight coefficient for carrying out linear combination on the plurality of input signals, and an apparatus for generating an output signal according to the beam forming weight coefficient and the plurality of input signals, wherein the optimizing a mathematical model comprises suppressing interferences in the plurality of input signals and obtaining an optimization equation of the beam forming weight coefficient, the optimization equation comprising the following items:

$$\min_{w,\epsilon}\max_{k}\{\gamma_k\epsilon_k\}$$

$$\text{s.t. } |\bar{h}_\phi^H w|^2 \le \epsilon_k c_\phi^2,\ \forall\ \phi \in \Phi_k,\ k = 1, \ldots, K$$

Wherein $|\bar{h}_\phi^H w|^2 \le \epsilon_k c_\phi^2$, $\forall \phi \in \Phi_k$, k=1, . . . , K is an inequality constraint for an interference, $\bar{h}_\phi = h_\phi + / h_{\phi,r}$ is a relative transfer function RTF at the interference angle $\phi$, $h_{\phi,r}$ r is the $r^{th}$ component of the acoustic transfer function $h_\phi$, $c_\phi > 0$ is a preset control constant, $\epsilon_k$ is an additional optimization variable, $\Phi_k$ is a set of discrete interference angles that is preset to be a set of desired angles close to the angle of arrival of the interference, w indicates a beam forming weight coefficient used under certain frequency bands, $\{\gamma_k\}_{k=1}^{K}$ is a penalizing parameter, and K is a number of interferences.

In the beam former according to one embodiment of the present invention, an inequality constraint for a target is introduced into the optimization equation:

$$|\bar{h}_\theta^H w - 1|^2 \le c_\theta^2,\ \forall \theta \in \Theta,$$

wherein $\bar{h}_\theta = h_\theta / h_{\theta,r}$ is an RTF at a target angle $\theta$, $h_{\theta,r}$ is the $r^{th}$ component of the acoustic transfer function $h_\theta$, $\Theta$ is a set of discrete target angles that is preset to be a set of desired angles close to the angle of arrival of the target, and the constant $c_\phi$ is a tolerable speech distortion threshold at the target angle $\theta$.

In the beam former according to one embodiment of the present invention, the inequality constraint for an interference comprises that there is one inequality constraint for each interference angle θ included in the set of discrete interference angles $\Phi_k$, so as to improve the robustness against DoA errors.

In the beam former according to one embodiment of the present invention, the inequality constraint for a target comprises that there is one inequality constraint for each target angle θ included in the set of discrete target angles Θ, so as to improve the robustness against DoA errors.

In the beam former according to one embodiment of the present invention, the obtaining a beam forming weight coefficient comprises that an ADMM algorithm is used to solve the optimization equation.

In the beam former according to one embodiment of the present invention, the using the ADMM algorithm to solve the optimization equation comprises the following process: introducing auxiliary variables $\delta_\Theta$ and $\delta_\Phi$ into the optimization equation to obtain an equation:

$$\min_{w,\delta_\Theta,\delta_\Phi,\epsilon} w^H R_n w + \mu \max_k \{\gamma_k \epsilon_k\} \tag{5a}$$

$$\text{s.t. } |\delta_\theta - 1|^2 \le c_\theta^2, \forall \theta \in \Theta \tag{5b}$$

$$\bar{h}_\theta^H w = \delta_\theta, \forall \theta \in \Theta, \tag{5c}$$

$$|\delta_\phi|^2 \le \epsilon_k c_\phi^2, \forall \phi \in \Phi_k, \forall k, \tag{5d}$$

$$\bar{h}_\phi^H w = \delta_\phi, \forall \phi \in \Phi_k, \forall k, \tag{5e}$$

wherein $\delta_\Theta$ is a complex vector formed by all elements in $(\delta_\theta|\theta\in\Theta)$, while $\delta_\Phi$ is formed by all elements in $\{\delta_\phi|\phi\in\Phi_k, k=1, 2, \ldots, K\}$, $$\min_w w^H R_n w$$

is energy of minimized background noise, wherein $R_n \triangleq \mathbb{E}[nn^H]$ is a background noise-related matrix, and μ is an additional parameter for compromise between noise reduction and interference suppression; an augmented Lagrange function $L_\rho(w,\delta_\Theta,\delta_\Phi,\in,\lambda_\Theta,\lambda_\Phi)$ is introduced:

$$L_\rho(w, \delta_\Theta, \delta_\Phi, \epsilon, \lambda_\Theta, \lambda_\Phi) = w^H R_n w + \mu \max_k \{\gamma_k \epsilon_k\} + \sum_{\theta\in\Theta} \mathrm{Re}\{\lambda_\theta^H (\bar{h}_\theta^H w - \delta_\theta)\} + \frac{\rho}{2}|\bar{h}_\theta^H w - \delta_\theta|^2 + \sum_k \sum_{\phi\in\Phi_k} \mathrm{Re}\{\lambda_\phi^H (\bar{h}_\phi^H w - \delta_\phi)\} + \frac{\rho}{2}|\bar{h}_\phi^H w - \delta_\phi|^2,$$

wherein $\lambda_\Theta$ and $\lambda_\Phi$ are Lagrange factors related to Equations (5c) and (5e), ρ>0 is a predefined penalizing parameter for the ADMM algorithm, and Re{.} indicates an operation to take the real portion, and therefore. Equations (5a) to (5e) are revised to $$\min_{w,\delta_\Theta,\delta_\Phi,\epsilon,\lambda_\Theta,\lambda_\Phi} L_\rho(w, \delta_\Theta, \delta_\Phi, \epsilon, \lambda_\Theta, \lambda_\Phi) \tag{6a}$$

$$\text{s.t. } |\delta_\theta - 1|^2 \le c_\theta^2, \forall \theta \in \Theta \tag{6b}$$

$$|\delta_\theta|^2 \le \epsilon_k c_\phi^2, \forall \phi \in \Phi_k \forall k, \tag{6c}$$

the ADMM algorithm is used to solve this equation, wherein all variables are updated by the ADMM algorithm in the following manner:

$$w^{r+1} = \underset{w}{\operatorname{argmin}} L_\rho(w, \delta_\Theta^r, \delta_\Phi^r, \epsilon^r, \lambda_\Theta^r, \lambda_\Phi^r), \tag{7a}$$

$$\delta_\Theta^{r+1} = \underset{(6b)}{\operatorname{argmin}} L_\rho(w^{r+1}, \delta_\Theta, \delta_\Phi^r, \epsilon^r, \lambda_\Theta^r, \lambda_\Phi^r), \tag{7b}$$

$$(\delta_\Phi^{r+1}, \epsilon^{r+1}) = \underset{(6c)}{\operatorname{argmin}} L_\rho(w^{r+1}, \delta_\Theta^{r+1}, \delta_\Phi, \epsilon, \lambda_\Theta^r, \lambda_\Phi^r), \tag{7c}$$

$$\lambda_\Theta^{r+1} = \lambda_\Theta^r + \rho(H_\Theta^H w - \delta_\Theta^{r+1}), \tag{7d}$$

$$\lambda_\Phi^{r+1} = \lambda_\Phi^r + \rho(H_\Phi^H w - \delta_\Phi^{r+1}), \tag{7e}$$

wherein r=0, 1, 2, . . . is an iteration index, and $\overline{H}_\Theta$ and $\overline{H}_\Phi$ are matrices formed by $\{\bar{h}_\Theta\}$ and $\{\bar{h}_\Phi\}$, respectively; in the circumstance where the beam former can process any number of interferences, the iteration $(w^r,E^r)$ generated by Equations (7a) to (7e) converges to the optimal solution of the optimization equation when $r\to\infty$, thereby solving the optimization equation.

According to another embodiment of the present invention, the present application discloses a beam forming method for a beam former, comprising: receiving a plurality of input signals, obtaining a beam forming weight coefficient for carrying out linear combination on the plurality of input signals by optimizing a mathematical model and solving an algorithm, and generating an output signal according to the beam forming weight coefficient and the plurality of input signals, wherein the optimizing a mathematical model comprises suppressing interferences in the plurality of input signals and obtaining an optimization equation of the beam forming weight coefficient, the optimization equation comprising the following items:

$$\min_{w,\epsilon} \max_k \{\gamma_k \epsilon_k\}$$

$$\text{s.t. } |\bar{h}_\phi^H w|^2 \le \epsilon_k c_\phi^2, \forall \phi \in \Phi_k, k = 1, \ldots, K$$

wherein $|\bar{h}_\Phi^H w|^2 \le \in_k c_\Phi^2$, $\forall\phi\in\Phi_k$, k=1, . . . , K is an inequality constraint for an interference, $\bar{h}_\Phi = h_\Phi/h_{\Phi,r}$, is a relative transfer function RTF at the interference angle ϕ, $h_{\Phi,r}$ is the $r^{th}$ component of the acoustic transfer function $h_\Phi$, $c_\Phi>0$ is a preset control constant, $\in_k$ is an additional optimization variable, $\Phi_k$ is a set of discrete interference angles that is preset to be a set of desired angles close to the angle of arrival of the interference, w indicates a beam forming weight coefficient used under certain frequency bands. $\{\gamma_k\}_{k=1}^K$ is a penalizing parameter, and K is a number of interferences.

In the beam former according to one embodiment of the present invention, an inequality constraint for a target is introduced into the optimization equation:

$$|\bar{h}_\Theta^H w - 1|^2 \le c_\Theta^2, \forall\theta\in\Theta,$$

wherein $\bar{h}_\Theta = h_\Theta/h_{\Theta,r}$ is an RTF at a target angle θ, $h_{\Theta,r}$ is the $r^{th}$ component of the acoustic transfer function $h_\Theta$, Θ is a set of discrete target angles that is preset to be a set of desired angles close to the angle of arrival of the target, and the constant $c_\Phi$ is a tolerable speech distortion threshold at the target angle θ.

In the beam former according to one embodiment of the present invention, the inequality constraint for an interference comprises that there is one inequality constraint for each interference angle ϕ included in the set of discrete interference angles $\Phi_k$, so as to improve the robustness against DoA errors.

In the beam former according to one embodiment of the present invention, the inequality constraint for a target comprises that there is one inequality constraint for each target angle θ included in the set of discrete target angles Θ, so as to improve the robustness against DoA errors.

In the beam former according to one embodiment of the present invention, the obtaining a beam forming weight coefficient comprises that an ADMM algorithm is used to solve the optimization equation.

In the beam former according to one embodiment of the present invention, the using the ADMM algorithm to solve the optimization equation comprises the following process: introducing auxiliary variables $\delta_\Theta$ and $\delta_\Phi$ into the optimization equation to obtain an equation:

$$\min_{w,\delta_\Theta,\delta_\Phi,\epsilon} w^H R_n w + \mu \max_k \{\gamma_k \epsilon_k\} \tag{5a}$$

$$s.t. |\delta_\theta - 1|^2 \le c_\theta^2,\ \forall\, \theta \in \Theta, \tag{5b}$$

$$\overline{h}_\theta^H w = \delta_\theta,\ \forall\, \theta \in \Theta, \tag{5c}$$

$$\delta_\phi|^2 \le \epsilon_k c_\phi^2,\ \forall\, \phi \in \Phi_k,\ \forall\, k, \tag{5d}$$

$$\overline{h}_\Phi^H w = \delta_\phi,\ \forall\, \phi \in \Phi_k,\ \forall\, k, \tag{5e}$$

wherein $\delta_\Theta$ is a complex vector formed by all elements in $\{\delta_\Theta|\theta\in\Theta\}$, while $\delta_\Phi$ is formed by all elements in $\{\delta_\phi|\phi\in\Phi_k, k=1, 2, \ldots, K\}$, $$\min_w w^H R_n w$$

is energy of minimized background noise, wherein $R_n \triangleq \mathbb{E}[nn^H]$ is a background noise-related matrix, and μ is an additional parameter for compromise between noise reduction and interference suppression; an augmented Lagrange function $L_\rho(w,\delta_\Theta,\delta_\Phi,\in,\lambda_\Theta,\lambda_\Phi)$ is introduced:

$$L_\rho(w, \delta_\Theta, \delta_\Phi, \epsilon, \lambda_\Theta, \lambda_\Phi) = w^H R_n w + \mu \max_k \{\gamma_k \epsilon_k\} + \sum_{\theta\in\Theta} Re\{\lambda_\theta^H(\overline{h}_\theta^H w - \delta_\theta)\} + \frac{\rho}{2}\left|\overline{h}_\theta^H w - \delta_\theta\right|^2 + \sum_k \sum_{\phi\in\Phi_k} Re\{\lambda_\phi^H(\overline{h}_\phi^H w - \delta_\phi)\} + \frac{\rho}{2}\left|\overline{h}_\phi^H w - \delta_\phi\right|^2.$$

wherein $\lambda_\Theta$ and $\lambda_\Phi$ are Lagrange factors related to Equations (5c) and (5e), ρ>0 is a predefined penalizing parameter for the ADMM algorithm, and Re{.} indicates an operation to take the real portion, and therefore, Equations (5a) to (5e) are revised to $$\min_{w,\delta_\Theta,\delta_\Phi,\epsilon,\lambda_\Theta,\lambda_\Phi} L_\rho(w, \delta_\Theta, \delta_\Phi, \epsilon, \lambda_\Theta, \lambda_\Phi) \tag{6a}$$

$$s.t. |\delta_\theta - 1|^2 \le c_\theta^2,\ \forall\, \theta \in \Theta, \tag{6b}$$

$$|\delta_\phi|^2 \le \epsilon_k c_\phi^2,\ \forall\, \phi \in \Phi_k,\ \forall\, k, \tag{6c}$$

the ADMM algorithm is used to solve this equation, wherein all variables are updated by the ADMM algorithm in the following manner:

$$w^{r+1} = \underset{w}{\operatorname{argmin}} L_\rho(w, \delta_\Theta^r, \delta_\Phi^r, \epsilon^r, \lambda_\Theta^r, \lambda_\Phi^r), \tag{7a}$$

$$\delta_\Theta^{r+1} = \underset{(6b)}{\operatorname{argmin}} L_\rho(w^{r+1}, \delta_\Theta, \delta_\Phi^r, \epsilon, \lambda_\Theta^r, \lambda_\Phi^r), \tag{7b}$$

$$(\delta_\Phi^{r+1}, \epsilon^{r+1}) = \underset{(6c)}{\operatorname{argmin}} L_\rho(w^{r+1}, \delta_\Theta^{r+1}, \delta_\Phi, \epsilon, \lambda_\Theta^r, \lambda_\Phi^r), \tag{7c}$$

$$\lambda_\Theta^{r+1} = \lambda_\Theta^r + \rho(\overline{H}_\Theta^H w - \delta_\Theta^{r+1}), \tag{7d}$$

$$\lambda_\Phi^{r+1} = \lambda_\Phi^r + \rho(\overline{H}_\Phi^H w - \delta_\Phi^{r+1}), \tag{7e}$$

wherein r=0, 1, 2, . . . is an iteration index, and $\overline{H}_\Theta$ and $\overline{H}_\Phi$ are matrices formed by $\{\overline{h}_\theta\}$ and $\{\overline{h}_\phi\}$, respectively; in the circumstance where the beam former can process any number of interferences, the iteration $(w^r,\in^r)$ generated by Equations (7a) to (7e) converges to the optimal solution of the optimization equation when r→∞, thereby solving the optimization equation.

According to yet another embodiment of the present invention, the present application discloses a hearing aid system for processing speeches from a sound source, comprising: a microphone configured to receive a plurality of input sounds and generate a plurality of input signals representing the plurality of input sounds, the plurality of input sounds comprising speeches from the sound source, a processing circuit configured to process the plurality of input signals to generate an output signal, and a loudspeaker configured to use the output signal to generate an output sound comprising the speech, wherein the processing circuit comprises the beam former according to the present invention.

According to a further embodiment of the present invention, the present application discloses a non-transitory computer readable medium comprising instructions, and when executed, the instructions may operate to at least implement the beam forming method according to the present invention.

BRIEF DESCRIPTION OF THE DRAWINGS

FIG. 2 is a schematic diagram of an exemplary embodiment of an ADMM algorithm used for solving the optimization equation of the P-ICMV beam former in FIG. 1 according to the present invention.

DETAILED DESCRIPTION

The present disclosure will be described in further detail below with reference to the following embodiments. It should be noted that the following description of some embodiments is presented only for the purpose of illustration and description and is not intended to be exhaustive or limited to the disclosed accurate format.

In mathematical equations illustrated in the present application, bolded lowercase letters represent vectors, and bolded uppercase letters represent matrices; H is a sign for conjugate transpose; the set of all n-dimensional complex vectors is represented by $\mathbb{C}^n$; $x_i \in \triangleq$ is the $i^{th}$ element of $x \in \mathbb{C}^n$; and x-i $\triangleq [x_1^H, \ldots, x_{i-1}^H, \ldots, x_{i-1}^H, \ldots, x_n^H]^H$.

The following specific implementation manners of the present application refer to the subject matter of the accompanying drawings. By means of examples, the accompanying drawings of the description of the present application illustrate specific aspects and embodiments capable of implementing the present application. These embodiments are fully described to cause those skilled in the art to implement the subject matter of the present application. The citation of "an or one" or "various" embodiments of the present disclosure does not necessarily for the same embodiment, and such citation is expected to have more than one embodiment. The following specific implementation manners are exemplary rather than limitative.

Mathematical equations for describing a beam former according to embodiments of the present application will be presented hereinafter. The beam former according to embodiments of the present application is an extension of ICMV and intended to process more interferences. In order to overcome the DoF limitation when the number of microphones is smaller than or equal to the number of interferences, in the beam former according to embodiments of the present application, the inequality constraint in the ICMV equation is revised to a penalizing version, i.e., realizing a P-ICMV beam former. By using a relative transfer function (RTF) (a normalized acoustic transfer function relative to a reference microphone (which may be, for example, the front microphone at each side)), the P-ICMV beam former is realized by balancing the following three aspects: (I) speech distortion control; (II) interference suppression, and (III) noise reduction.

Figure 1:
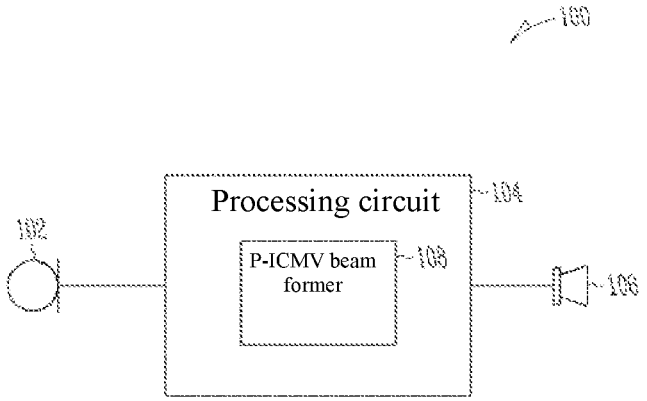
FIG. 1 is a block diagram of an exemplary embodiment of a hearing aid system comprising the P-ICMV beam former according to the present invention.

FIG. 1 is a block diagram of an exemplary embodiment of a hearing aid system 100 comprising the P-ICMV beam former 108 according to the present invention. The hearing aid system 100 comprises a microphone 102, a processing circuit 104, and a loudspeaker 106. In one embodiment, the hearing aid system 100 is implemented in one hearing aid of a pair of dual-ear hearing aids, and there are 1 target and K interferences in the environment. The microphone 102 represents M microphones, all of which receive sound and generate electric signals representing the input sound. The processing circuit 104 processes (one or more) microphone signals to generate an output signal. The loudspeaker 106 uses the output signal to generate an output sound including the speech. In various embodiments, the input sound may include various components, such as speech and/or noise/interference, as well as sounds from the loudspeaker 106 via the sound feedback path. The processing circuit 104 comprises an adaptive filter to reduce noise and sound feedback. In the illustrated embodiment, the adaptive filter comprises the P-ICMV beam former 108. In various embodiments, when the hearing aid system 100 is implemented in one hearing aid of a pair of dual-ear hearing aids, the processing circuit 104 receives at least another microphone signal from the other hearing aid of the pair of dual-ear hearing aids, and the P-ICMV beam former 108 uses microphone signals from both hearing aids to provide adaptive dual-ear beam formation.

In various embodiments, the P-ICMV beam former 108 is configured to process all interferences in the environment by introducing optimization variables for interference suppression and inequality constraints for interferences, and at the same time, improve the robustness of the target against DoA errors by applying a plurality of constraints at adjacent angles close to the estimated target DoA for speech distortion control, as well as improve the robustness by applying a plurality of constraints at interference angles within a set of discrete interference angles at or adjacent to DoA of estimated interferences; in addition, selectively suppress interferences through suppression preferences for interferences provided by penalizing parameters for interference suppression. In various embodiments, the P-ICMV beam former 108 is used in dual-ear hearing aid applications.

In the embodiments of the present invention, microphone signals received by the P-ICMV beam former 108 and serving as input signals to the P-ICMV beam former 108 may be expressed in a time-frequency domain as follows, $$y(l, f) = h_s(f)s(l, f) + \sum_{k=1}^{K} h_k(f)i_k(l, f) + n(l, f) \in \mathbb{C}^{2M}$$

wherein y(l, f) represents a microphone signal at Frame 1 and Frequency Band f; $h_s(f) \in \mathbb{C}^{2M}$ and $h_k(f) \in \mathbb{C}^{2M}$ represent ATF of the target and ATF of the $k^{th}$ interference; $s(l, f) \in \mathbb{C}$ and $i_k(l, f) \in \mathbb{C}$ represent a target signal and the $k^{th}$ interference signal, respectively; and $n(l, f) \in \mathbb{C}^{2M}$ represents background noise.

In the embodiments of the present invention, the P-ICMV beam former 108 performs linear combinations on input signals to generate an output signal at each ear. Specifically, let $W_L(f) \in \mathbb{C}^{2M}$ and $w_R(f) \in \mathbb{C}^{2M}$ represent beam forming weight coefficients applied by Frequency Band f on left ear and right ear, respectively. The output signals at the left hearing aid and the right hearing aid are:

$$Z_L(l,f)=w_L^{HY}(f)y(l,f),zR(l,f)=w_R^H(f)y(l,f)$$

to simplify symbols. L and R, as well as time coefficient 1 and frequency coefficient f will be omitted hereinafter.

In the embodiments of the present invention, the P-ICMV beam former 108 is configured to comprise an apparatus for optimizing a mathematical model and solving an algorithm, which obtains a beam forming weight coefficient for carrying out linear combination on the plurality of input signals, wherein the optimizing a mathematical model comprises suppressing interferences in the plurality of input signals and obtaining an optimization equation of the beam forming weight coefficient. In various embodiments, the processing circuit 104 is configured to further solve the optimization equation by using an ADMM algorithm, so that output signals of the P-ICMV beam former 108 meet the standards prescribed for the output signals, including (I) speech distortion control; (II) interference suppression, and (III) noise reduction.

Here, (I) speech distortion control: to balance target distortion and noise/interference suppression, the equality constraint in LCMV is relaxed to an inequality constraint capable of tolerating distortions. In addition, a plurality of constraints at adjacent angles close to the estimated target DoA η may be applied to improve the robustness of the target against DoA errors. As a result, the following inequality constraint for the target is obtained:

$$|\bar{h}_\theta^H w - 1|^2 \le c_\theta^2, \ \forall \theta \in \Theta \quad (1)$$

wherein $\bar{h}_\theta = h_\theta / h_{\theta,r}$ is RTF at the target angle θ, $h_{\theta,r}$ is the $r^{th}$ component of ATF $h_\theta$, Θ is a set of discrete target angles that is preset to be a set of desired angles close to the angle of arrival of the target, and the constant $c_\phi$ is a tolerable speech distortion threshold at the target angle θ.

(II) Interference suppression: when the number of microphones in an array is smaller than the number of interferences, i.e., when 2M is smaller than or equal to K, direct application of the equality constraint $w^H h_k = 0$ or the inequality constraint $|w^H h_k|^2 \le c^2$ to suppress all interferences may lead to an impractical solution. To solve this problem, an additional optimization variable $\in_k$ (k=1, 2, . . . , K) is introduced and minimal and maximal optimization standards are proposed to simultaneously use relaxed constraints to suppress all K interferences, as shown by Equation (2):

$$\min_{w,\epsilon} \max_k \{\gamma_k \epsilon_k\} \tag{2}$$

$$s.t.\ \left|\bar{h}_\phi^H w\right|^2 \le \epsilon_k c_\phi^2,\ \forall\, \phi \in \Phi_k,\ k = 1, \ldots, K$$

wherein $|\bar{h}_\phi^H w|^2 \le \in_k c_\phi^2$, $\forall \phi \in \Phi_k$, k=1, . . . , K is an inequality constraint for an interference, $\bar{h}_\theta$ is RTF at the interference angle φ, $c_\phi > 0$ is a preset control constant, $\Phi_k$ is a set of discrete interference angles that is preset to be a set of desired angles close to the angle of arrival of the interference, $\{\gamma_k\}_{k=1}^K$ is a penalizing parameter, and s.t. represents being limited by. The additional optimization variables $\in_k$ and $c_\phi^2$ define the upper limit of spatial response: $|h_\phi^H w|^2 \le \in_k c_\phi^2 |h_{\phi,r}|^2$, $\phi \in \Phi_k$.

It should be noted that in the embodiments of the present invention, the present invention needs to consider the robustness against DoA errors for both the target and interferences. Therefore, multi-angle constraints are applied on each signal. For example, the inequality constraint $|\bar{h}_\theta^H w - 1|^2 \le c_\theta^2$, $\forall \theta \in \Theta$ for the target indicates that there is one inequality constraint $|\bar{h}_\theta^H w - 1|^2 \le c_\theta^2$, for each target angle θ included in the set of discrete target angles Θ, so as to improve the robustness against DoA errors. Here, for different estimated target DoA η, the set of discrete target angles Θ should be considered to be close to η, e.g., Θ=η+(−10°,0°, 10°). Similarly, the inequality constraint $|\bar{h}_\phi^H w|^2 \le \in_k c_\phi^2$, $\forall \phi \in \Phi_k$, k=1, . . . , K for interferences indicates that there is one inequality constraint $|\bar{h}_\phi^H w|^2 \le \in_k c_\phi^2$ for each interference angle φ included in the set of discrete interference angles $\Phi_k$, so as to improve the robustness against DoA errors. Here, for $\zeta_k$ (which represents estimated DoA of the $k^{th}$ interference), the set of discrete interference angles $\Phi_k$ should be considered to be close to $\zeta_k$, e.g., $\Phi_k = \zeta_k + \{-5°, 0°, 5°\}$.

It should be noted that the constant in Equation 2 is always solvable by using an additional optimization variable. Moreover, the variable causes the upper limit of $|h_\phi^H w|^2$ to be adjustable. Therefore, the number of constraints for interference suppression is no longer limited by DoF. In other words, when 2M≥|Θ|, the P-ICMV beam former 108 may process any number of interferences, wherein 2M represents a total number of microphones, |Θ| represents a number of target angles in the set of discrete target angles Θ, and if Θ=η+{−10°,0°,10°}, then Θ=3. In the embodiments of the present invention, as long as 2M≥|Θ| is satisfied, i.e., the number of microphones is greater than or equal to the number of constraints for the target, the optimization equation surely has a solution. i.e., P-ICMV can process any number of interferences.

It should be further noted that the penalizing function $$\mu \max_k \{\gamma_k \epsilon_k\}$$

comprising an optimization variable $\in_k$ enables the P-ICMV beam former 108 to intelligently allocate DoF, thereby using a relatively great weight $\gamma_k$ to minimize interferences to be processed. As a result, selective interference suppression is allowed, thereby providing additional advantages in many practical applications. For example, a relatively great weight may be applied to an interference having relatively great degree of noise. In other words, the penalizing parameter $(\gamma_k)_{k=1}^K$, provides a suppression preference: interferences having relatively great γ will be suppressed with higher priority.

(III) Noise reduction: energy of background noise is minimized by reduction according to minimum variance standards, $$\min_w \mathbb{E}_n\left[|w^H n|^2\right] \equiv \min_w w^H R_n w \tag{3}$$

wherein $R_n \triangleq \mathbb{E}[nn^H]$ is a background noise-related matrix.

Given these conditions, the optimization equation for the P-ICMV beam former 108 having robustness according to the subject matter of the present invention may be obtained:

$$\min_{w,\epsilon}\ w^H R_n w + \mu \max_k \{\gamma_k \epsilon_k\} \tag{4a}$$

$$s.t.\ \left|\bar{h}_\theta^H w - 1\right|^2 \le c_\theta^2,\ \forall\, \theta \in \Theta \tag{4b}$$

$$\left|\bar{h}_\phi^H w\right|^2 \le \epsilon_k c_\phi^2,\ \forall\, \phi \in \Phi_k,\ k = 1, \ldots, K \tag{4c}$$

This is the initial equation of the P-ICMV beam former. It should be noted that the optimal solution $\in_k$ may not be 0. Here, an additional parameter μ is introduced for compromise between noise reduction and interference suppression.

In various embodiments, this optimization equation is second-order cone programming (SOCP), and a general interior point solver (M. Grant, S. Boyd and Y. Ye. "CVX: Matlab software for disciplined convex programming," 2008) can be used to solve the optimization equation. However, in the field of hearing aid applications, relevant computation is still very complicated. An effective optimization algorithm (i.e., the ADMM algorithm) will be derived for Equation (4) below, which has simple update rules for each iteration.

In various embodiments, the processing circuit 104 is configured to solve the optimization equation by using an ADMM algorithm. In the embodiments of the present invention, auxiliary variables $\delta_\Theta$ and $\delta_\phi$ are first introduced, wherein $\delta_\Theta$ is a complex vector formed by all elements in $\{\delta_\theta | \theta \in \Theta\}$, while $\delta_\phi$ is formed by all elements in $\{\delta_\phi | \phi \in \Phi_k$, k=1, 2, . . . , K}. With the auxiliary variables, Equation (4) may be equivalently expressed as:

$$\min_{w,\delta_\Theta,\delta_\phi,\epsilon}\ w^H R_n w + \mu \max_k \{\gamma_k \epsilon_k\} \tag{5a}$$

$$s.t. |\delta_\theta - 1|^2 \le c_\theta^2,\ \forall\, \theta \in \Theta, \tag{5b}$$

-continued $$\bar{h}_\theta^H w = \delta_\theta,\ \forall\, \theta \in \Theta, \tag{5c}$$

$$\delta_\phi|^2 \le \epsilon_k c_\phi^2,\ \forall\, \phi \in \Phi_k,\ \forall\, k, \tag{5d}$$

$$\bar{h}_\Phi^H w = \delta_\phi,\ \forall\, \phi \in \Phi_k,\ \forall\, k, \tag{5e}$$

This is the equivalent equation of Equation (4). The introduction of the auxiliary variables $\delta_\Theta$ and $\delta_\Phi$ makes it easier mathematically to solve the above equation.

To process the equality constraints in Equations (5c) and (5e) in Equation (5), an augmented Lagrange function $L_\rho(w,\delta_\Theta,\delta_\Phi,\in,\lambda_\Theta,\lambda_\Phi)$ is introduced (see S. Boyd, N. Parikh, E. Chu, B. Peleato and J. Eckstein, "Distributed optimization and statistical learning via the alternating direction method of multipliers," Foundation and Trend of Machine Learning®, Volume 3, No. 1, pages 1-122, 201):

$$L_\rho(w, \delta_\Theta, \delta_\Phi, \epsilon, \lambda_\Theta, \lambda_\Phi) = w^H R_n w + \mu \max_k\{\gamma_k \epsilon_k\} + \sum_{\theta\in\Theta} Re\{\lambda_\theta^H(\bar{h}_\theta^H w - \delta_\theta)\} + \frac{\rho}{2}|\bar{h}_\theta^H w - \delta_\theta|^2 + \sum_k \sum_{\phi\in\Phi_k} Re\{\lambda_\phi^H(\bar{h}_\phi^H w - \delta_\phi)\} + \frac{\rho}{2}|\bar{h}_\phi^H w - \delta_\phi|^2.$$

wherein $\lambda_\Theta$ and $\lambda_\Phi$ are Lagrange factors related to Equations (5c) and (5e), $\rho>0$ is a predefined penalizing parameter for the ADMM algorithm, and Re{.} indicates an operation to take the real portion.

Equation 5 may be revised to $$\min_{w,\delta_\Theta,\delta_\Phi,\epsilon,\lambda_\Theta,\lambda_\Phi} L_\rho(w, \delta_\Theta, \delta_\Phi, \epsilon, \lambda_\Theta, \lambda_\Phi) \tag{6a}$$

$$s.t. |\delta_\theta - 1|^2 \le c_\theta^2,\ \forall\, \theta \in \Theta, \tag{6b}$$

$$|\delta_\phi|^2 \le \epsilon_k c_\phi^2,\ \forall\, \phi \in \Phi_k,\ \forall\, k, \tag{6c}$$

The advantage of Equation 6 is that each iteration has a closed solution, as described below.

When the iteration r=0, 1, 2, . . . , the ADMM algorithm updates all variables in the following manner:

$$w^{r+1} = \underset{w}{\operatorname{argmin}} L_\rho(w, \delta_\Theta^r, \delta_\Phi^r, \epsilon^r, \lambda_\Theta^r, \lambda_\Phi^r), \tag{7a}$$

$$\delta_\Theta^{r+1} = \underset{(6b)}{\operatorname{argmin}} L_\rho(w^{r+1}, \delta_\Theta, \delta_\Phi^r, \epsilon, \lambda_\Theta^r, \lambda_\Phi^r), \tag{7b}$$

$$(\delta_\Phi^{r+1}, \epsilon^{r+1}) = \underset{(6c)}{\operatorname{argmin}} L_\rho(w^{r+1}, \delta_\Theta^{r+1}, \delta_\Phi, \epsilon, \lambda_\Theta^r, \lambda_\Phi^r), \tag{7c}$$

$$\lambda_\Theta^{r+1} = \lambda_\Theta^r + \rho(\bar{H}_\Theta^H w - \delta_\Theta^{r+1}), \tag{7d}$$

$$\lambda_\Phi^{r+1} = \lambda_\Phi^r + \rho(\bar{H}_\Phi^H w - \delta_\Phi^{r+1}), \tag{7e}$$

wherein $\bar{H}_\Theta$ and $\bar{H}_\Phi$ are matrices formed by $\{_h\theta\}$ and $\{\bar{h}\phi_\}$, respectively, and (6b) in Equation (7b) and (6c) in Equation (7c) represent the constraints (6b) and (6c) in Equation (6), respectively. FIG. 2 is a schematic diagram of an embodiment of the process of the ADMM algorithm.

With regard to the above ADMM algorithm, the present invention proposes the following proposition.

Proposition 1 (see S. Boyd. N. Parikh, E. Chu, B. Peleato and J. Eckstein, "Distributed optimization and statistical learning via the alternating direction method of multipliers," Foundation and Trend of Machine Learning®, Volume 3, No. 1, pages 1-122, 2011): if $2M \ge |\Theta|$, the iteration $(w^r, \in^r)$ generated by Equation (7) converges to the optimal solution of Equation (4) when $r \to \infty$.

Next, closed solutions in sub-equations (7a), (7b), and (7c) for each iteration are derived. For the sake of simplicity, the iteration index r is omitted.

(1) Solve the beam forming weight coefficient w from Equation (7a): the sub-equation (7a) for w is a convex quadratic formula without constraints and is expressed as:

$$\min_w\ w^H R_n w + \sum_{\theta\in\Theta} Re\{\lambda_\theta^H(\bar{h}_\theta^H w - \delta_\theta)\} + \frac{\rho}{2}|\bar{h}_\theta^H w - \delta_\theta|^2 + \sum_k \sum_{\phi\in\Phi_k} Re\{\lambda_\phi^H(\bar{h}_\phi^H w - \delta_\phi)\} + \frac{\rho}{2}|\bar{h}_\phi^H w - \delta_\phi|^2.$$

The optimal w is obtained in the closed form:

$$w' = -A^{-1}b,$$

wherein $$A = R_n + \frac{\rho}{2}\sum_{\theta\in\Theta} \bar{h}_\theta \bar{h}_\theta^H + \sum_k \sum_{\phi\in\Phi_k} \bar{h}_\phi \bar{h}_\phi^H$$

$$b = \frac{1}{2}\left[\sum_{\theta\in\Theta}(\bar{h}_\theta\lambda_\theta - \rho\bar{h}_\theta\delta_\theta) + \sum_k \sum_{\phi\in\Phi_k}(\bar{h}_\phi\lambda_\phi - \rho\bar{h}_\phi\delta_\phi)\right]$$

(2) Solve $\delta_\Theta$ from Equation (7b): the sub-equation (7b) is separable relative to $\delta_\theta$, $\theta\in\Theta$. Therefore, each optimal $\delta_\theta, \theta\in\Theta$ may be obtained by solving the following equation, respectively:

$$\min_{\delta_\theta}\ Re\{\lambda_\theta^H(\bar{h}_\theta^H w - \delta_\theta)\} + \frac{\rho}{2}|\bar{h}_\theta^H w - \delta_\theta|^2\ \ s.t. |\delta_\theta - 1|^2 \le c_\theta^2.$$

The closed solution of $\delta_\Theta$ in the closed form may be expressed as:

$$\delta_\theta = \begin{cases} (\lambda_\theta + \rho\bar{h}_\theta^H w)/\rho, & |\lambda_\theta + \rho\bar{h}_\theta^H w - \rho| \le \rho c_\theta, \\ 1 + \dfrac{\lambda_\theta + \rho\bar{h}_\theta^H w}{|\lambda_\theta + \rho\bar{h}_\theta^H w|} c_\theta, & \text{others.} \end{cases}$$

wherein others represent all other situations in which $|\lambda_\theta + \rho\bar{h}_\theta^H w - \rho| \le \rho c_\theta$ is not satisfied.

(3) Solve $\delta_\Phi$ and $\in$ from Equation (7c): the sub-equation (7c) regarding $\delta_\Phi$ and $\in$ is equivalent to:

$$\min_{\delta_\Phi,\epsilon,t} \mu t + \sum_k \sum_{\phi\in\Phi_k} \mathrm{Re}\{\lambda_\phi^H(h_\phi^H w - \delta_\phi)\} + \frac{\rho}{2}|h_\phi^H w - \delta_\phi|^2$$

$$\text{s.t.} |h_\phi^H w|^2 \le \epsilon_k c_\phi^2,\ \forall\, \phi \in \Phi_k,\ k = 1, \ldots, K,$$

$$\gamma_k \epsilon_k \le t,\ k = 1, \ldots, K.$$

Under the Karush-Kuhn-Tucker (KKT) optimization conditions (see D. P. Bertsekas, Nonlinear programming, Athena Scientific Belmont, 1999), the optimal t* may be obtained by solving the root of the following equation regarding t in the interval $[t \in (0, t_{max}]$, wherein $t_{max} = \max_k \max_{\phi \in \Phi_k} \{\gamma_k |\tau_\phi / c_\phi|^2\}$:

$$\sum_k \sum_{\phi \in \Phi_k} c_\phi^2 \max\left\{0, \frac{|\lambda_\phi + \rho \bar{h}_\phi^H w|}{2\sqrt{t/\gamma_k c_\phi^2}} - \frac{\rho}{2}\right\} = \mu$$

Based on the obtained root t*, it would be easy to extract the closed optimal $\delta_\phi^*, \phi \in \Phi_k$ and $\in_k^*$ from t*. Due to the spatial limitation, the expressions of $\{\delta_\phi^*\}$ and $(\in_k^*)$ are omitted.

Figure 3:
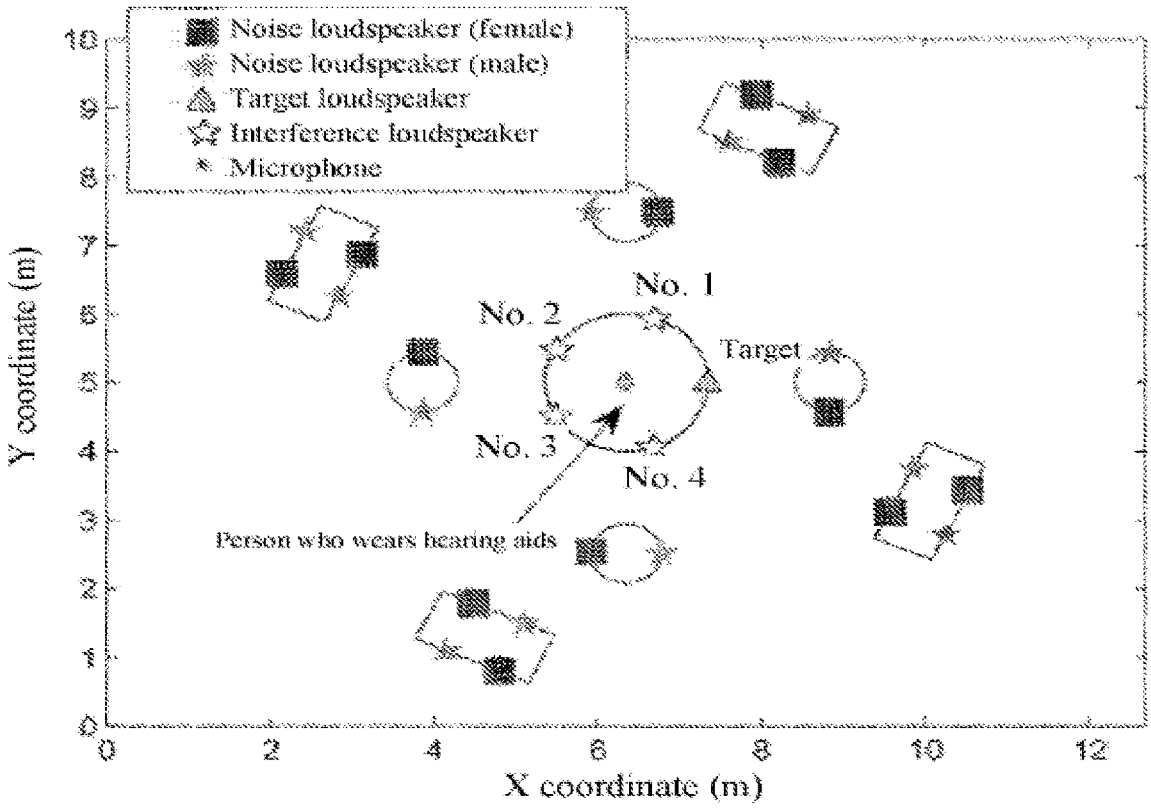
FIG. 3 illustrates a simulated acoustic environment used for comparing the P-ICMV beam former according to an embodiment of the present application and existing beam formers (LCMV and ICMV).

FIG. 3 illustrates a simulated acoustic environment used for comparing the P-ICMV beam former 108 according to an embodiment of the present application and existing beam formers (LCMV and ICMV). The simulated acoustic environment has the following environmental settings: a squared room with a size of 12.7×10 m and height of 3.6 m; the reverberation time is set to 0.6 s; the room impulse response (RIR) is generated with the so-called mirroring method (see J. B. Allen and D. A. Berkley, "Image method for efficiently simulating small-room acoustics," Journal of the Acoustical Society of America, Vo. 65, No. 4, pages 943-950, 1979): a person wearing hearing aids is in the center of a room; each hearing aid has two microphones and there is a gap of 7.5 mm between the microphones; the front microphone is set as a reference microphone; a target source and interference sources are loudspeakers that are 1 m away from the person wearing hearing aids; the target is 0 degree; there is a total of 4 interferences at ±70° and ±150° (No. 1 through No. 4 in FIG. 3); the background babble noise is simulated with 24 loudspeakers at different positions; all loudspeakers and microphones are located on the same horizontal plane with a height of 1.2 m; the signal-to-noise ratio (SNR) at the location of the reference microphone is set to 5 dB, while the signal-to-interference ratio (SIR) of each interference is set to −10 dB; signals are sampled at 16 kHz; 1024 FFT points with 50% overlapping are used to convert the signals to the time-frequency domain; and intelligibility-weighted SINR improvement (IW-SINRI) and intelligibility-weighted spectral distortion (IW-SD) are used as performance metrics.

In this simulation, all 4 interferences are used and three beam formers (P-ICMV, LCMV and ICMV) are compared in terms of performance. There is a total of 5 sources, including the target. Since there are only 4 microphones, LCMV and ICMV can at most suppress 3 interferences except the target. In this specification, "scenario i" indicates that the interference i (FIG. 3) is omitted, while the remaining other interferences are suppressed (by using corresponding constraints for the interferences), wherein i=1, 2, 3, 4. Table 1 lists detailed parameter settings. In this simulation, it is assumed that echoless ATF and DoA of each sound source are known. In Table 2, the three beam formers are compared in terms of performance. In all the 4 scenarios, in terms of the IW-SINRI metrics, P-ICMV can suppress more interferences and noises compared with LCMV and ICMV. In terms of IW-SD scores, the three beam formers have similar speech distortion.

TABLE 1

Parameter settings for LCMV, ICMV, and P-ICMV

| LCMV-i | ICMV-i | P-ICMV |
|---|---|---|
| $w^H R_n w$ | $w^H \hat{R}_n w$ | $w^H \hat{R}_n w + \mu \max_k \gamma_k \in_k$ |
| $\bar{h}_\eta^H w = 1$ | $\lvert \bar{h}_\eta^H w - 1 \rvert^2 \le 0.05^2$ | $\lvert \bar{h}_\eta^H w - 1 \rvert^2 \le 0.05^2$ |
| $\bar{h}_{\xi k}^H w = 0, k \in T_i$ | $\lvert \bar{h}_{\xi k}^H w \rvert^2 \le 0.01^2, k \in T_i$ | $\lvert \bar{h}_{\xi k}^H w \rvert^2 \le 0.01^2 \in_k, \forall k$ |
| $T_i = \{1,2,3,4\}/\{i\}$ | $T_i = \{1,2,3,4\}/\{i\}$ | $\mu = 10, \gamma_k = 10, \forall k$ |

TABLE 2

IW-SINRI and IW-SD [dB]

| | IW-SINRI | | | | IW-SD | | | |
|---|---|---|---|---|---|---|---|---|
| Scenario | 1 | 2 | 3 | 4 | 1 | 2 | 3 | 4 |
| LCMV | 7.25 | −4.20 | −0.09 | 8.39 | 0.83 | 2.11 | 2.02 | 0.77 |
| ICMV | 7.43 | −3.92 | 0.16 | 8.50 | 0.97 | 2.12 | 2.05 | 0.92 |
| P-ICMV | 9.70 | | | | 1.20 | | | |

It can be further seen that in Scenario 1 and Scenario 4 where one front interference is omitted, LCMV/ICMV achieves reasonable interference suppression. However, in Scenario 2 and Scenario 3 where one rear interference is omitted, the beam formers achieve poor SNRI improvement. This can be explained through respective interference suppression levels and corresponding snapshots of beam patterns.

Figure 4:
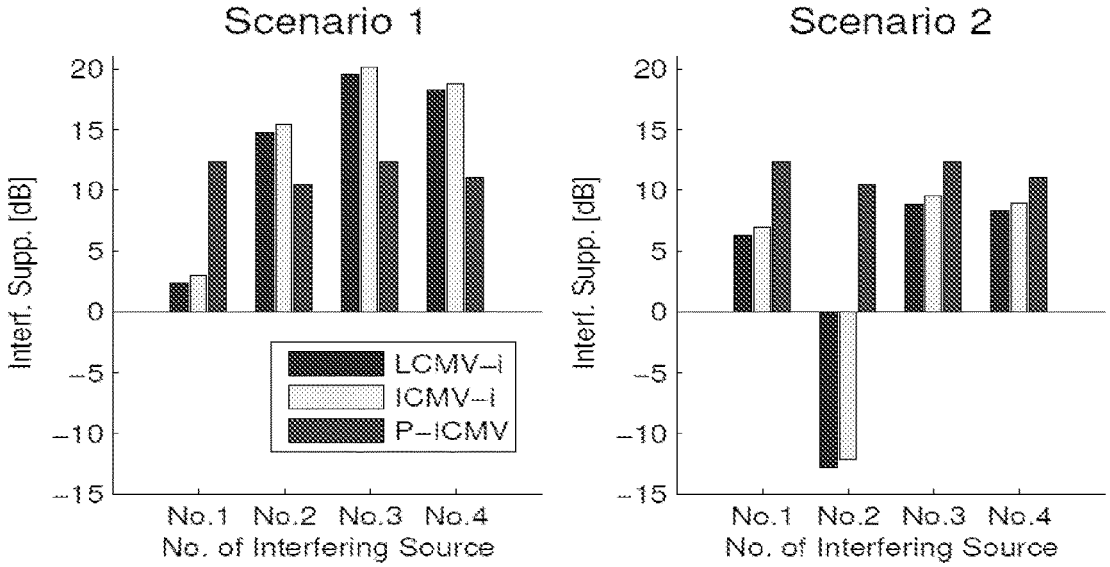
FIG. 4 illustrates respective interference suppression levels of the beam former according to an embodiment of the present application and LCMV and ICMV beam formers.

FIG. 4 illustrates respective interference suppression levels of the P-ICMV beam former according to an embodiment of the present application and LCMV and ICMV beam formers.

FIG. 4 illustrates that respective interference suppression levels in Scenario 1 and Scenario 2 are defined as $20 \log_{10} r_{in}/r_{out}$, wherein $r_{in}$ is a root mean square (RMS) of signals at the reference microphone, and $r_{out}$ is RMS of signals at the output of a beam former. Similar behaviors may also be found in Scenario 3 and Scenario 4, and no diagrams thereof will be provided herein. Therefore. P-ICMV may achieve about 10 dB interference suppression for all interferences, while LCMV and ICMV only suppress constrained interferences. Depending on different scenarios, the omitted interference is either slightly suppressed or even augmented.

Figure 5:
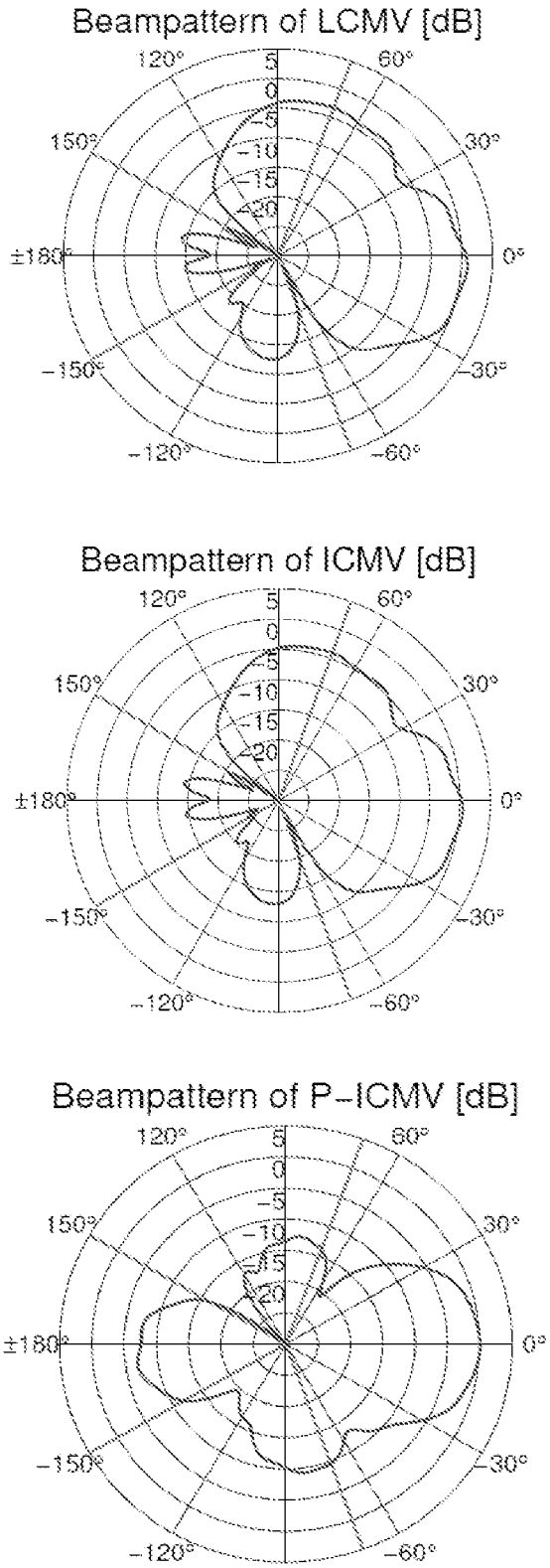
FIG. 5 illustrates beam patterns of the P-ICMV beam former according to an embodiment of the present application and LCMV and ICMV beam formers at the frequency 1 kHz in Scenario 1 of FIG. 4.
Figure 6:
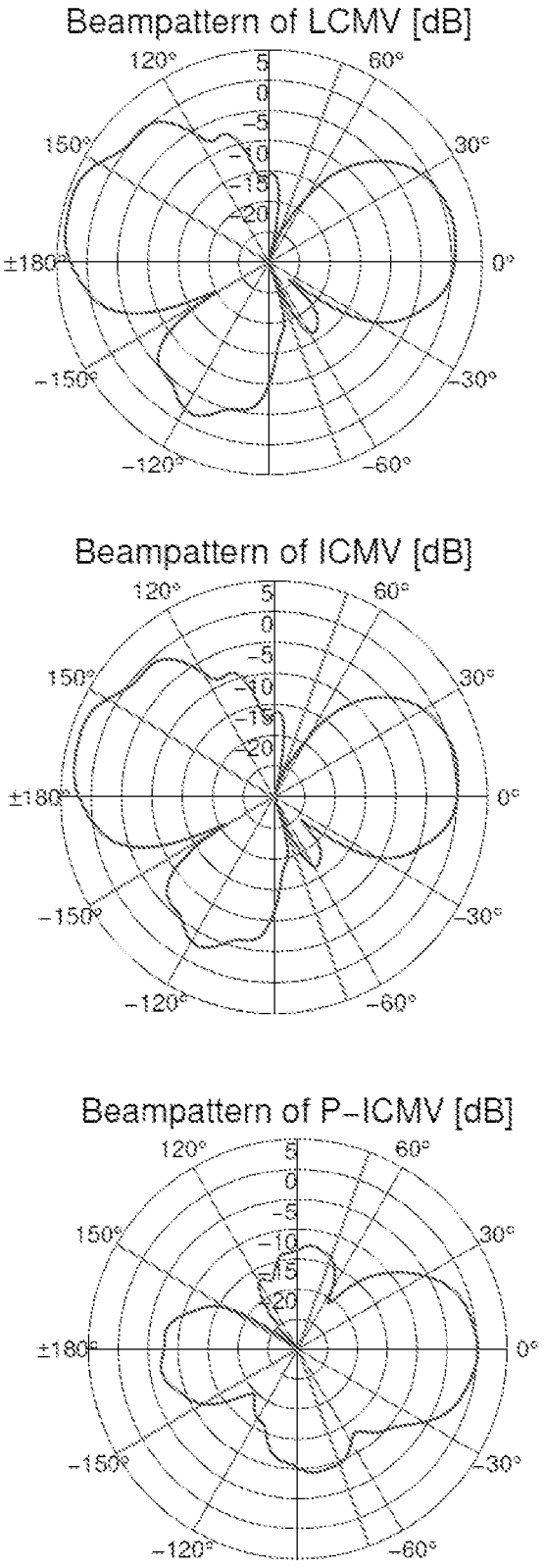
FIG. 6 illustrates beam patterns of the P-ICMV beam former according to an embodiment of the present application and LCMV and ICMV beam formers at the frequency 1 kHz in Scenario 2 of FIG. 4.

FIG. 5 and FIG. 6 illustrate snapshots of beam patterns of the three beam formers at 1 kHz in Scenario 1 and Scenario 2. It can be seen that the spatial response by P-ICMV has low gain at all the 4 interferences. For LCMV and ICMV, the omitted interference direction (70 degrees) has a reasonable gain control due to the target constraint, but in Scenario 2, the omitted interference direction (150 degrees) is still very high (greater than 0 dB).

In this simulation, the three beam formers are compared in the presence of target DoA errors or interference DoA errors. To simplify the comparison, one interference is simulated only at −150 degree. Two equality constraints are designated for LCMV with one of the equality constraints for the target $\bar{h}_\eta^H w = 1$, while the other equality constraint is for interferences: $\bar{h}_\xi^H w = 0$.

ICMV and P-ICMV both have three inequality constraints for the target:

$$|\bar{h}_\theta^H w - 1|^2 \le c_\theta^2, \theta \in \Theta, \text{ wherein}$$

$\Theta = (-10°, 0°, 10°) + \eta$ and the constant $c_\Theta = (10, 5, 10) \times 10^{-2}$.

However, due to the limited DoF, ICMV only applies one inequality constraint for interference suppression: $|\bar{h}_\xi^H w|^2 \le c_\xi^2$, wherein $c_\xi = 10^{-2}$. P-ICMV is not limited by DoF. Therefore, the robustness for interference suppression may be achieved by applying three inequality constraints: $|\bar{h}_\phi^H w|^2 \le \in_k c_\phi^2$, $\forall \phi \Phi_k$, k=1, . . . , K, wherein $\Phi_k = \zeta_k + \{-5°, 0°, 5°\}$ and the constant $c_\Phi = \{2,1,2\} \times 10^{-2}$.

In Table 3, the three beam formers are compared in terms of performance in the case where DoA errors change. As the DoA error increases from 0 degree to 15 degrees, LCMV significantly deteriorates in aspects of interference suppression and target speech protection. Even when the DoA error increases, ICMV and P-ICMV can still maintain the target speech. However, due to the limitation by DoF, ICMV still suffers DoA error in the aspect of interference suppression. When the DoA error changes from 0 degree to 15 degrees, the IW-SINR performance of ICMV deteriorates by more than 4 dB, but it is smaller than 2 dB for P-ICMV.

TABLE 3

| IW-SINRI and IW-SD [dB] | | | | | | | | |
|---|---|---|---|---|---|---|---|---|
| | IW-SINRI | | | | IW-SD | | | |
| DoA error | 0° | 5° | 10° | 15° | 0° | 5° | 10° | 15° |
| LCMV | 20.80 | 18.05 | 14.29 | 12.10 | 0.90 | 1.67 | 4.40 | 6.35 |
| ICMV | 18.18 | 17.00 | 15.15 | 13.90 | 0.94 | 1.04 | 1.21 | 1.41 |
| P-ICMV | 17.19 | 17.16 | 16.80 | 15.40 | 0.82 | 0.84 | 0.95 | 1.05 |

The present application proposes an adaptive dual-ear beam former using a convex optimization tool. Through penalizing inequality constraints, the beam former according to the embodiments of the present application can process any number of interferences, which provides a solution for beam formation in an array with limited DoF. At the same time, for hearing aid applications, an iterative algorithm with low complexity that can be effectively implemented is derived in the present application. In the numerical simulation, the comparison with existing adaptive beam formers shows that the beam former according to the embodiments of the present application can process more sources and has the robustness against DoA errors.

It should be understood that the hearing aids cited in the present application comprise a processor, which may be DSP, microprocessor, microcontroller or other digital logic. Signal processing cited in the present application may be executed by the processor. In various embodiments, the processing circuit 104 may be implemented on such a processor. The processing may be completed in a digital domain, an analog domain, or a combination thereof. The processing may be completed using sub-band processing techniques. A frequency domain or time domain method may be used to complete the processing. For the sake of simplicity, block diagrams for carrying out frequency synthesis, frequency analysis, analog to digital conversion, amplification and other types of filtering and processing may be omitted in some examples. In various embodiments, the processor is configured to execute instructions stored in a memory. In various embodiments, the processor executes instructions to carry out a number of signal processing tasks. In such embodiments, an analog component communicates with the processor to carry out signal tasks, such as a microphone receiving or receiver sound embodiment (i.e., in an application of using this sensor). In various embodiments, the block diagrams, circuits or processes herein may be implemented without departing from the scope of the subject matter of the present application.

The subject matter of the present application is illustrated as being applied to a hearing aid device, including hearing aids, including but not limited to Behind the Ear (BTE) hearing aids, In the Ear (ITE) hearing aids, In the Canal (ITC) hearing aids, Receiver In Canal (RIC) hearing aids, or Completely In Canal (CIC) hearing aids. It should be understood that BTE hearing aids may include devices substantially behind the ear or above the ear. Such devices may include hearing aids having receivers associated with an electronic part of a BTE device or hearing aids having a type of receivers in the canal of a user, including but not limited to the design of Receiver In Canal (RIC) or Receiver In the Ear (RITE). The subject matter of the present application can typically be further used in hearing aid devices, such as artificial cochlear implant-type hearing aid devices. It should be understood that other hearing aid devices not specifically set forth herein may be used in combination with the subject matter of the present application.

The following exemplary embodiments of the present invention are further described:

Embodiment 1. A beam former comprises:

an apparatus for receiving a plurality of input signals, an apparatus for optimizing a mathematical model and solving an algorithm, which obtains a beam-forming weight coefficient for carrying out linear combination on the plurality of input signals, and an apparatus for generating an output signal according to the beam forming weight coefficient and the plurality of input signals, wherein the optimizing a mathematical model comprises suppressing interferences in the plurality of input signals and obtaining an optimization equation of the beam forming weight coefficient, the optimization equation comprising the following items:

$$\min_{w,\epsilon}\max_{k}\{\gamma_k\epsilon_k\}$$

$$\text{s.t.}\left|\bar{h}_\phi^H w\right|^2 \le \epsilon_k c_\phi^2,\ \forall\ \phi\in\Phi_k,\ k=1,\ldots,K,$$

wherein $|\bar{h}_\phi^H w|^2 \le \in_k c_\phi^2$, $\forall\phi\in\Phi_k$, k=1, . . . , K is an inequality constraint for an interference, $\bar{h}_\phi = h_\phi / h_{\phi,r}$, is a relative transfer function RTF at the interference angle $\phi$, $h_{\theta,r}$ is the $r^{th}$ component of the acoustic transfer function $h_\phi$, $c_\phi > 0$ is a preset control constant, $\in_k$ is an additional optimization variable, $\Phi_k$ is a set of discrete interference angles that is preset to be a set of desired angles close to the angle of arrival of the interference, w indicates a beam forming weight coefficient used under certain frequency bands, $\{y_k\}_{k=1}^K$ is a penalizing parameter, and K is a number of interferences.

Embodiment 2. The beam former according to Embodiment 1, wherein the obtaining the beam forming weight coefficient comprises using the optimization equation to execute speech distortion control, interference suppression, and noise reduction in output signals.

Embodiment 3. The beam former according to Embodiment 1, wherein the solving the optimization equation comprises using an algorithm to solve the optimization equation.

Embodiment 4. The beam former according to Embodiment 3, wherein the algorithm is the ADMM algorithm.

Embodiment 5. The beam former according to Embodiment 2, wherein an inequality constraint for a target is introduced into the optimization equation for the speech distortion control.

Embodiment 6. The beam former according to Embodiment 2, wherein optimization variables and an inequality constraint for an interference are introduced into the optimization equation for the interference suppression.

Embodiment 7. The beam former according to Embodiment 6, wherein the optimization variables cause the upper limit of the inequality constraint for an interference to be adjustable, so that the beam former may process any number of interferences.

Embodiment 8. The beam former according to Embodiment 6 or 7, wherein the optimization equation further comprises a penalizing parameter for the interference suppression, and wherein the optimization variables and the penalizing parameter form a penalizing function, and the penalizing function intelligently allocates DoF thereby minimizing interferences whose penalizing parameters are relatively great.

Embodiment 9. The beam former according to Embodiment 2, wherein a plurality of constraints at adjacent angles close to the estimated target angle are applied for the speech distortion control, so as to improve the robustness thereof against DoA errors.

Embodiment 10. The beam former according to Embodiment 2, wherein a plurality of constraints at angles within a set $\Phi_k$ at or adjacent to DOA $\zeta_k$ of estimated interferences are applied for the interference suppression, so as to improve the robustness.

Embodiment 11. A beam forming method used for a beam former comprises:

receiving a plurality of input signals, obtaining a beam forming weight coefficient for carrying out linear combination on the plurality of input signals by optimizing a mathematical model and solving an algorithm, and generating an output signal according to the beam forming weight coefficient and the plurality of input signals, wherein the optimizing a mathematical model comprises suppressing interferences in the plurality of input signals and obtaining an optimization equation of the beam forming weight coefficient, the optimization equation comprising the following items:

$$\min_{w,\epsilon}\max_{k}\{\gamma_k\epsilon_k\}$$

$$\text{s.t.}\left|\bar{h}_\phi^H w\right|^2 \le \epsilon_k c_\phi^2,\ \forall\,\phi\in\Phi_k,\ k=1,\ldots,K$$

wherein $|\bar{h}_\phi^H w|^2 \le \in_k c_\phi^2$, $\forall\phi\in\Phi_k$, k=1, . . . , K is an inequality constraint for an interference, $\bar{h}_\phi = h_\phi / h_{\phi,r}$ is a relative transfer function RTF at the interference angle $\phi$, $h_{\phi,r}$ is the r component of the acoustic transfer function $h_\phi$, $c_\phi > 0$ is a preset control constant, $\in_k$ is an additional optimization variable, $\Phi_k$ is a set of discrete interference angles that is preset to be a set of desired angles close to the angle of arrival of the interference, w indicates a beam forming weight coefficient used under certain frequency bands, $\{\gamma_k\}_{k=1}^{K}$, is a penalizing parameter, and K is a number of interferences.

Embodiment 12. The beam forming method according to Embodiment 11, wherein the obtaining the beam forming weight coefficient comprises using the optimization equation to execute speech distortion control, interference suppression, and noise reduction in output signals.

Embodiment 13. The beam forming method according to Embodiment 11, wherein the solving the optimization equation comprises using an algorithm to solve the optimization equation.

Embodiment 14. The beam forming method according to Embodiment 13, wherein the algorithm is the ADMM algorithm.

Embodiment 15. The beam forming method according to Embodiment 12, wherein an inequality constraint for a target is introduced into the optimization equation for the speech distortion control.

Embodiment 16. The beam forming method according to Embodiment 12, wherein optimization variables and an inequality constraint for an interference are introduced into the optimization equation for the interference suppression.

Embodiment 17. The beam forming method according to Embodiment 16, wherein the optimization variables cause the upper limit of the inequality constraint for an interference to be adjustable, so that the beam former may process any number of interferences.

Embodiment 18. The beam forming method according to Embodiment 16 or 17, wherein the optimization equation further comprises a penalizing parameter for the interference suppression, and wherein the optimization variables and the penalizing parameter form a penalizing function, and the penalizing function intelligently allocates DoF, thereby minimizing interferences whose penalizing parameters are relatively great.

Embodiment 19. The beam forming method according to Embodiment 12, wherein a plurality of constraints at adjacent angles close to the estimated target angle are applied for the speech distortion control, so as to improve the robustness thereof against DoA errors.

Embodiment 20. The beam forming method according to Embodiment 12, wherein a plurality of constraints at angles within a set $\Phi_k$ at or adjacent to DOA $\zeta_k$ of estimated interferences are applied for the interference suppression, so as to improve the robustness.

Embodiment 21. A hearing aid system comprises:

the beam former according to any one of Embodiments 1-10;

at least one processor; and at least one memory, comprising computer program codes of one or more programs; the at least one memory and the computer program codes are configured to use the at least one processor to cause the apparatus to at least implement: the beam forming method according to any one of Embodiments 11-20.

Embodiment 22. A non-transitory computer readable medium comprising instructions, wherein, when executed, the instructions may operate to at least implement: the beam forming method according to any one of Embodiments 11-20.

The present application is intended to cover implementation manners of the subject matter of the present application or variations thereof. It should be understood that the description is intended to be exemplary, rather than limitative.

The invention claimed is:

1. A beam former, comprising:

an apparatus for receiving a plurality of input signals, an apparatus for optimizing a mathematical model and solving an algorithm, which obtains a beam forming weight coefficient for carrying out linear combination on the plurality of input signals, and an apparatus for generating an output signal according to the beam forming weight coefficient and the plurality of input signals, wherein the optimizing a mathematical model comprises suppressing interferences in the plurality of input signals and obtaining an optimization equation of the beam forming weight coefficient, the optimization equation comprising the following items:

$$\min_{w,\epsilon}\max_{k}\{\gamma_k\epsilon_k\}$$

$$\text{s.t.}\left|\bar{h}_\phi^H w\right|^2 \le \epsilon_k c_\phi^2,\ \forall\,\phi\in\Phi_k,\ k=1,\ldots,K$$

wherein $|\bar{h}_\phi^H w|^2 \le \in_k c_\phi^2$, $\forall\phi\in\Phi_k$, k=1, . . . , K is an inequality constraint for an interference, $\bar{h}_\phi = h_\phi/h_{\phi,r}$ is a relative transfer function RTF at the interference angle $\phi$, $h_{\phi,r}$ is the $r^{th}$ component of the acoustic transfer function $h_\phi$, $c_\phi>0$ is a preset control constant, $\in_k$ is an additional optimization variable, $\Phi_k$ is a set of discrete interference angles that is preset to be a set of desired angles close to the angle of arrival of the interference, w indicates a beam forming weight coefficient used under certain frequency bands, $\{\gamma_k\}_{k=1}^K$, is a penalizing parameter, and K is a number of interferences.

2. The beam former according to claim 1, wherein an inequality constraint for a target is introduced into the optimization equation:

$$|\bar{h}_\theta^H w-1|^2 \le c_\theta^2,\ \forall\phi\in\Theta$$

wherein $\bar{h}_\theta = h_\theta/h_{\theta,r}$ is an RTF at a target angle $\theta$, $h_{\theta,r}$ is the $r^{th}$ component of the acoustic transfer function $h_\theta$, $\Theta$ is a set of discrete target angles that is preset to be a set of desired angles close to the angle of arrival of the target, and the constant $c_\phi$ is a tolerable speech distortion threshold at the target angle $\theta$.

3. The beam former according to claim 2, wherein the inequality constraint for a target comprises that there is one inequality constraint for each target angle $\phi$ included in the set of discrete target angles $\Theta$, so as to improve the robustness against DoA errors.

4. The beam former according to claim 1, wherein the inequality constraint for an interference comprises that there is one inequality constraint for each interference angle $\phi$ included in the set of discrete interference angles $\Phi_k$, so as to improve the robustness against DoA errors.

5. The beam former according to claim 1, wherein the obtaining the beam forming weight coefficient comprises that an ADMM algorithm is used to solve the optimization equation.

6. The beam former according to claim 5, wherein the using the ADMM algorithm to solve the optimization equation comprises the following process:

introducing auxiliary variables $\delta_\Theta$ and $\delta_\Phi$ into the optimization equation to obtain an equation:

$$\min_{w,\delta_\Theta,\delta_\Phi,\epsilon} w^H R_n w + \mu\max_k\{\gamma_k\epsilon_k\} \tag{5a}$$

$$s.t.|\delta_\theta - 1|^2 \le c_\theta^2,\ \forall\,\theta\in\Theta, \tag{5b}$$

$$\bar{h}_\theta^H w = \delta_\theta,\ \forall\,\theta\in\Theta, \tag{5c}$$

$$|\delta_\phi|^2 \le \epsilon_k c_\phi^2,\ \forall\,\phi\in\Phi_k,\ \forall\,k, \tag{5d}$$

$$\bar{h}_\phi^H w = \delta_\phi,\ \forall\,\phi\in\Phi_k,\ \forall\,k, \tag{5e}$$

wherein $\delta_\Theta$ is a complex vector formed by all elements in $\delta_\Theta\{\delta_\theta|\theta\in\Theta\}$, while $\delta_\Phi$ is formed by all elements in $(\delta_\phi|\phi\in\Phi_k$, k=1, 2, . . . , K), $$\min_w w^H R_n w$$

is energy of minimized background noise, wherein $R_n \triangleq \mathbb{E}[nn^H]$ is a background noise-related matrix, and $\mu$ is an additional parameter for compromise between noise reduction and interference suppression: an augmented Lagrange function $L_\rho(w,\delta_\Theta,\delta_\Phi,\in,\lambda_\Theta,\lambda_\Phi)$ is introduced:

$$L_\rho(w,\delta_\theta,\delta_\Phi,\epsilon,\lambda_\Theta,\lambda_\Phi) = w^H R_n w + \mu\max_k\{\gamma_k\epsilon_k\} + \sum_{\theta\in\Theta}\mathrm{Re}\{\lambda_\theta^H(\bar{h}_\theta^H w-\delta_\theta)\} + \frac{\rho}{2}\left|\bar{h}_\theta^H w-\delta_\theta\right|^2 + \sum_k\sum_{\phi\in\Phi_k}\mathrm{Re}\{\lambda_\phi^H(\bar{h}_\phi^H w-\delta_\phi)\} + \frac{\rho}{2}\left|\bar{h}_\phi^H w-\delta_\phi\right|^2.$$

wherein $\lambda_\Theta$ and $\lambda_\Phi$ are Lagrange factors related to Equations (5c) and (5e), $\rho>0$ is a predefined penalizing parameter for the ADMM algorithm, and Re{.} indicates an operation to take the real portion, and therefore, Equations (5a) to (5e) are revised to $$\min_{w,\delta_\Theta,\delta_\Phi,\epsilon,\lambda_\Theta,\lambda_\Phi} L_\rho(w,\delta_\Theta,\delta_\Phi,\epsilon,\lambda_\Theta,\lambda_\Phi) \tag{6a}$$

$$\text{s.t.}|\delta_\theta - 1|^2 \le c_\theta^2,\ \forall\,\theta\in\Theta, \tag{6b}$$

$$|\delta_\phi|^2 \le \epsilon_k c_\phi^2,\ \forall\,\phi\in\Phi_k,\ \forall\,k, \tag{6c}$$

the ADMM algorithm is used to solve this equation, wherein all variables are updated by the ADMM algorithm in the following manner:

$$w^{r+1} = \underset{w}{\operatorname{argmin}}\, L_\rho(w,\delta_\Theta^r,\delta_\Phi^r,\epsilon^r,\lambda_\Theta^r,\lambda_\Phi^r), \tag{7a}$$

$$\delta_\theta^{r+1} = \underset{(6b)}{\operatorname{argmin}}\, L_\rho(w^{r+1},\delta_\Theta,\delta_\Phi^r,\epsilon^r,\lambda_\Theta^r,\lambda_\Phi^r), \tag{7b}$$

$$(\delta_\Phi^{r+1},\epsilon^{r+1}) = \underset{(6c)}{\operatorname{argmin}}\, L_\rho(w^{r+1},\delta_\Theta^{r+1},\delta_\Phi,\epsilon,\lambda_\Theta^r,\lambda_\Phi^r), \tag{7c}$$

$$\lambda_\Theta^{r+1} = \lambda_\Theta^r + \rho(\bar{H}_\Theta^H w - \delta_\Theta^{r+1}), \tag{7d}$$

$$\lambda_\Phi^{r+1} = \lambda_\Phi^r + \rho(\bar{H}_\Phi^H w - \delta_\Phi^{r+1}). \tag{7e}$$

wherein r=0, 1, 2, . . . is an iteration index, and $\bar{H}_\Theta$ and $\bar{H}_\Phi$ are matrices formed by $\{\bar{h}_\theta\}$ and $\{\bar{h}_\phi\}$, respectively; in the circumstance where the beam former can process any number of interferences, the iteration $(w^r,\in^r)$ generated by equations (7a) to (7e) converges to the optimal solution of the optimization equation when $r\to\infty$, thereby solving the optimization equation.

7. A hearing aid system for processing speeches from a sound source, comprising:

a microphone configured to receive a plurality of input sounds and generate a plurality of input signals representing the plurality of input sounds, the plurality of input sounds comprising speeches from the sound source, a processing circuit configured to process the plurality of input signals to generate an output signal, and a loudspeaker configured to use the output signal to generate an output sound comprising the speech, wherein the processing circuit comprises the beam former according to claim 1.

8. A beam forming method for a beam former, comprising:

receiving a plurality of input signals, obtaining a beam forming weight coefficient for carrying out linear combination on the plurality of input signals by optimizing a mathematical model and solving an algorithm, and generating an output signal according to the beam forming weight coefficient and the plurality of input signals, wherein the optimizing a mathematical model comprises suppressing interferences in the plurality of input signals and obtaining an optimization equation of the beam forming weight coefficient, the optimization equation comprising the following items:

$$\min_{w,\epsilon}\max_{k}\{\gamma_k\epsilon_k\}$$

$$\text{s.t.}\left|\bar{h}_\phi^H w\right|^2 \le \epsilon_k c_\phi^2,\ \forall\,\phi\in\Phi_k,\ k=1,\ldots,K$$

wherein $|\bar{h}_\phi^H w|^2 \le \in_k c_\phi^2$, $\forall\phi\in\Phi_k$, k=1, . . . , K is an inequality constraint for an interference, $\bar{h}_\phi = h_\phi/h_{\phi,r}$ is a relative transfer function RTF at the interference angle $\phi$, $h_{\phi,r}$ is the $r^{th}$ component of the acoustic transfer function $h_{\phi,r}$, $c_\phi>0$ is a preset control constant, $\in_k$ is an additional optimization variable, $\Phi_k$ is a set of discrete interference angles that is preset to be a set of desired angles close to the angle of arrival of the interference, w indicates a beam forming weight coefficient used under certain frequency bands, $\{\gamma_k\}_{k=1}^K$ is a penalizing parameter, and K is a number of interferences.

9. The beam forming method according to claim 8, wherein an inequality constraint for a target is introduced into the optimization equation:

$$|\bar{h}_\theta^H w-1|^2 \le c_\phi^2,\ \forall\theta\in\Theta$$

wherein $\bar{h}_\theta = h_\theta/h_{\theta,r}$ is an RTF at a target angle $\theta$, $h_{\theta,r}$ is the $r^{th}$ component of the acoustic transfer function $h_\theta$, $\Theta$ is a set of discrete target angles that is preset to be a set of desired angles close to the angle of arrival of the target, and the constant $c_\theta$ is a tolerable speech distortion threshold at the target angle $\theta$.

10. The beam forming method according to claim 9, wherein the inequality constraint for a target comprises that there is one inequality constraint for each target angle $\phi$ included in the set of discrete target angles $\Theta$, so as to improve the robustness against DoA errors.

11. The beam forming method according to claim 8, wherein the inequality constraint for an interference comprises that there is one inequality constraint for each interference angle $\phi$ included in the set of discrete interference angles $\Phi_k$, so as to improve the robustness against DoA errors.

12. The beam forming method according to claim 8, wherein the obtaining the beam forming weight coefficient comprises that an ADMM algorithm is used to solve the optimization equation.

13. The beam forming method according to claim 12, wherein the using the ADMM algorithm to solve the optimization equation comprises the following process:

introducing auxiliary variables $\delta_\Theta$ and $\delta_\Phi$ into the optimization equation to obtain an equation:

$$\min_{w,\delta_\Theta,\delta_\Phi,\epsilon} w^H R_n w + \mu\max_k\{\gamma_k\epsilon_k\} \tag{5a}$$

$$\text{s.t.}|\delta_\theta - 1|^2 \le c_\theta^2,\ \forall\,\theta\in\Theta, \tag{5b}$$

-continued $$\bar{h}_\theta^H w = \delta_\theta,\ \forall\,\theta\in\Theta, \tag{5c}$$

$$|\delta_\phi|^2 \le \epsilon_k c_\phi^2,\ \forall\,\phi\in\Phi_k,\ \forall\,k, \tag{5d}$$

$$\bar{h}_\phi^H w = \delta_\phi,\ \forall\,\phi\in\Phi_k,\ \forall\,k, \tag{5e}$$

wherein $\delta_\Theta$ is a complex vector formed by all elements in $\{\delta_\theta|\theta\in\Theta\}$, while $\delta_\Phi$ is formed by all elements in $\{\delta_\phi|\in\Phi_k$, k=1, 2, . . . , K$\}$, $$\min_w w^H R_n w$$

is energy of minimized background noise, wherein $R_n \triangleq \mathbb{E}[nn^H]$ is a background noise-related matrix, and $\mu$ is an additional parameter for compromise between noise reduction and interference suppression; an augmented Lagrange function $L_\rho(w,\delta_\Theta,\delta_\Phi,\in,\lambda_\Theta,\lambda_\Phi)$ is introduced:

$$L_\rho(w,\delta_\theta,\delta_\Phi,\epsilon,\lambda_\Theta,\lambda_\Phi) = w^H R_n W + \mu\max_k\{\gamma_k\epsilon_k\} + \sum_{\theta\in\Theta}\mathrm{Re}\{\lambda_\theta^H(\bar{h}_\theta^H w-\delta_\theta)\} + \frac{\rho}{2}\left|\bar{h}_\theta^H w-\delta_\theta\right|^2 + \sum_k\sum_{\phi\in\Phi_k}\mathrm{Re}\{\lambda_\phi^H(\bar{h}_\phi^H w-\delta_\phi)\} + \frac{\rho}{2}\left|\bar{h}_\phi^H w-\delta_\phi\right|^2.$$

wherein $\lambda_\Theta$ and $\lambda_\Phi$ are Lagrange factors related to Equations (5c) and (5e), $\rho>0$ is a predefined penalizing parameter for the ADMM algorithm, and Re{.} indicates an operation to take the real portion, and therefore, Equations (5a) to (5e) are revised to $$\min_{w,\delta_\Theta,\delta_\Phi,\epsilon,\lambda_\Theta,\lambda_\Phi} L_\rho(w,\delta_\Theta,\delta_\Phi,\epsilon,\lambda_\Theta,\lambda_\Phi) \tag{6a}$$

$$\text{s.t.}|\delta_\theta - 1|^2 \le c_\theta^2,\ \forall\,\theta\in\Theta, \tag{6b}$$

$$|\delta_\phi|^2 \le \epsilon_k c_\phi^2,\ \forall\,\phi\in\Phi_k,\ \forall\,k, \tag{6c}$$

the ADMM algorithm is used to solve this equation, wherein all variables are updated by the ADMM algorithm in the following manner:

$$w^{r+1} = \underset{w}{\operatorname{argmin}}\, L_\rho(w,\delta_\Theta^r,\delta_\Phi^r,\epsilon^r,\lambda_\Theta^r,\lambda_\Phi^r), \tag{7a}$$

$$\delta_\Theta^{r+1} = \underset{(6b)}{\operatorname{argmin}}\, L_\rho(w^{r+1},\delta_\Theta,\delta_\Phi^r,\epsilon^r,\lambda_\Theta^r,\lambda_\Phi^r), \tag{7b}$$

$$(\delta_\Phi^{r+1},\epsilon^{r+1}) = \underset{(6c)}{\operatorname{argmin}}\, L_\rho(w^{r+1},\delta_\Theta^{r+1},\delta_\Phi,\epsilon,\lambda_\Theta^r,\lambda_\Phi^r), \tag{7c}$$

$$\lambda_\Theta^{r+1} = \lambda_\Theta^r + \rho\left(\bar{H}_\Theta^H w - \delta_\Theta^{r+1}\right), \tag{7d}$$

$$\lambda_\Phi^{r+1} = \lambda_\Phi^r + \rho\left(\bar{H}_\Phi^H w - \delta_\Phi^{r+1}\right). \tag{7e}$$

wherein r=0, 1, 2, . . . is an iteration index, and $\bar{H}_\Theta$ and $\bar{H}_\Phi$ are matrices formed by $\{\bar{h}_\theta\}$ and $\{\bar{h}_\phi\}$, respectively; in the circumstance where the beam former can process any number of interferences, the iteration $(w^r,\in^r)$ generated by equations (7a) to (7e) converges to the optimal solution of the optimization equation when $r\to\infty$, thereby solving the optimization equation.

14. A non-transitory computer readable medium comprising instructions, wherein, when executed, the instructions may operate to at least implement the beam forming method according to claim 8.

* * * * *